United States Patent [19]

Dumont et al.

[11] Patent Number: 4,490,702

[45] Date of Patent: Dec. 25, 1984

[54] DETACHABLE DEVICE FOR LOCKING A CONTACTOR IN ITS "ON" POSITION

[75] Inventors: Alain D. G. Dumont, Certy; René Fouret, Rueil Malmaison, both of France

[73] Assignee: La Telemecanique Electrique, France

[21] Appl. No.: 477,579

[22] Filed: Mar. 21, 1983

[30] Foreign Application Priority Data

Mar. 19, 1982 [FR] France ..... 82 04681

[51] Int. Cl.[3] ..... H01H 9/20

[52] U.S. Cl. ..... 335/169; 335/168; 335/132; 335/190

[58] Field of Search ..... 335/132, 168, 169, 167, 335/170, 174, 190

[56] References Cited

U.S. PATENT DOCUMENTS

| | | | |
|---|---|---|---|
| 2,694,758 | 11/1954 | Keen | 335/161 |
| 3,812,440 | 5/1974 | Cook | 335/167 |
| 3,882,435 | 5/1975 | Grass et al. | 335/132 |
| 4,139,830 | 2/1979 | Streich et al. | 335/190 |
| 4,185,259 | 1/1980 | Forargue | 335/170 |

FOREIGN PATENT DOCUMENTS

| | | | |
|---|---|---|---|
| 733936 | 10/1932 | France | 335/161 |
| 755564 | 11/1933 | France | 335/161 |
| 1098724 | 6/1956 | France | 335/174 |
| 988678 | 4/1965 | United Kingdom | 335/161 |

*Primary Examiner*—George H. Miller, Jr.
*Assistant Examiner*—George Andrews
*Attorney, Agent, or Firm*—William A. Drucker

[57] ABSTRACT

A coupling piece (12) which is connected to a mobile component (18) of the contactor, has two stepped thrust surfaces (19, 20), each able to cooperate with one of two locking levers, (23, 24), both of which are repelled by an electromagnet (32) when the contactor is turned off. This device is particularly advantageous when the mobile components of the contactors move over different distances.

9 Claims, 10 Drawing Figures

FIG. 2
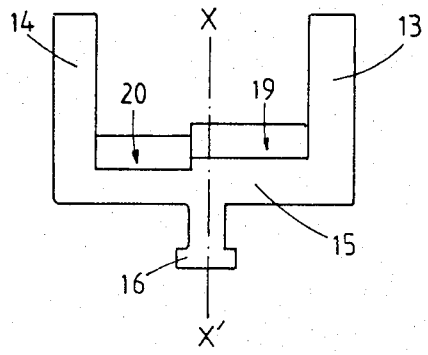
FIG. 7
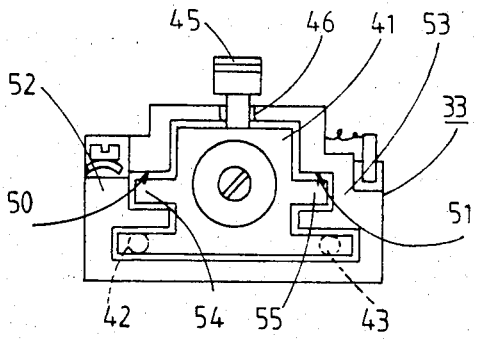
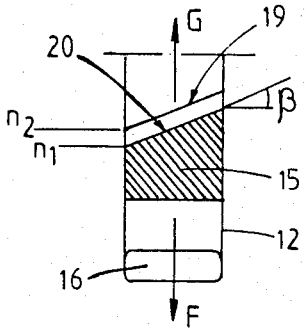
FIG. 5
FIG. 8
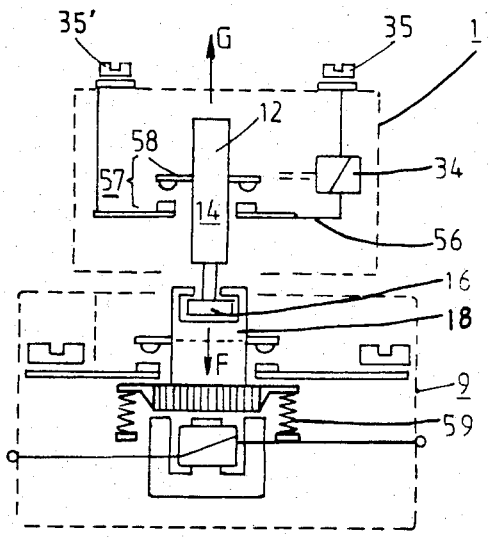
FIG. 6
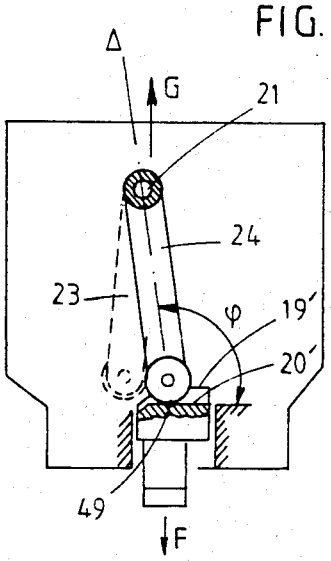

DETACHABLE DEVICE FOR LOCKING A CONTACTOR IN ITS "ON" POSITION

BACKGROUND OF THE INVENTION

The invention relates to a detachable device for locking the mobile component of a contactor in its ON position put to a rest position by a return spring and closing the power contacts of the contactor in the ON position, the said device comprising the following in a box:

a coupling piece which is linked to the movements of the mobile component and which moves between an inactive position when the component is off and an active position when it is on;

a locking lever which is able to oscillate around a pivot between a position that is released when the coupling piece is inactive and an engaged position imparted to it by a spring when the coupling piece is active;

a bearing surface on which bears a roller placed at the free end of the lever when the latter is engaged so that it is under longitudinal compression; and an unlocking electromagnet a mobile push rod of which works when it is energized, together with the locking lever to interrupt the thrust and give it its released position.

These locking devices are used when it is wished to maintain, for example, a contactor in its ON position without permanently energizing the electromagnet that closes the contacts. They then allow the said contactors to be activated by current pulses and thus to economise energy during the intervals between two pulses.

These locking devices are moreover very useful when it is desired to memorize the status of the switching devices of an installation when the power supply of their electromagnets is accidentally cut off and, for this reason, they allow the installation to be started up again under conditions identical to those that existed at the time of the breakdown; these devices are particularly advantageous when any safety circuits in such an installation have to be returned to service immediately after a breakdown.

Any detachable locking device which is fitted on a contactor must be able to maintain its switching components in an ON position at which the pressure between the contacts is appropriate, that is, the pressure between the fixed and mobile contacts must lie between figures that are close together and correctly determined.

This condition which is difficult to respect when the devices are fitted on contactors of the same type, because of the variety of manufacturing dimensions, becomes practically impossible to respect when the same locking device has to be adapted to apparatus of different types.

Such a difficulty appears particularly when the travel distances of the armatures of the contactor mechanisms are different as is the case with coils are fed with DC current and coils fed with AC current.

THE PRIOR ART

The previous state of the art has therefore offered means of adjustment which give the rollers of a locking lever an appropriate position in relation to the surfaces they have to cooperate with. This method has the drawback of requiring either an extra adjustment station on an assembly line or the supply of two types of locking devices that are different in accordance with their ultimate use.

OBJECT OF THE INVENTION

It is an object of the invention to provide a locking device that satisfies the above general constitution and which can be associated with switching devices which have, either relatively wide manufacturing tolerances, or working strokes that are significantly different and on which it will not be necessary to carry out systematic adaptation or adjustment during manufacture.

BRIEF DESCRIPTION OF THE DRAWINGS

The invention will be better understood upon reading of the following description.

In the appended drawing:

FIG. 2 illustrates, in elevation, a coupling piece detached from the instrument;

FIG. 5 illustrates a detail of FIG. 3;

FIG. 6 illustrates a view similar to that of FIG. 3, in which the coupling piece is slightly modified;

FIG. 7 illustrates a right-side view of the electromagnet illustrated in FIG. 4;

FIG. 8 illustrate, schematically, how an instrument covered by the invention can be associated with a contactor.

DESCRIPTION OF THE PREFERRED EMBODIMENT

Figure 1:
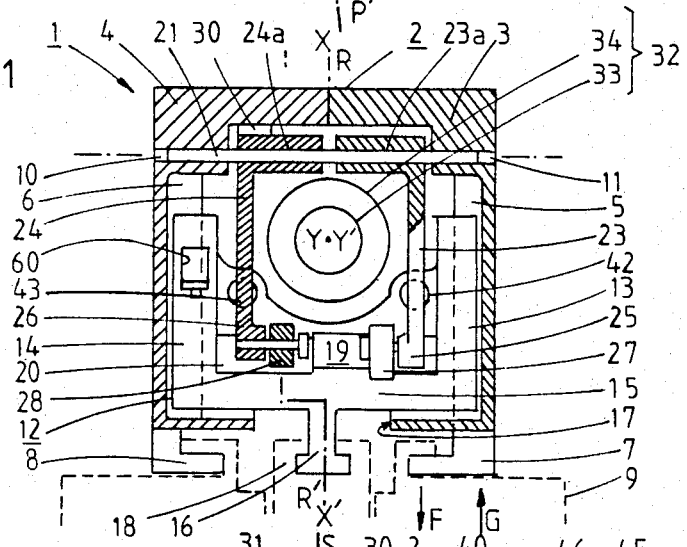
FIG. 1 illustrates, in elevation, a half cross-section of the device through plane SS' of FIG. 4.

In a preferred embodiment of the invention, visible in FIG. 1, the locking device 1 comprises a box 2 formed by the assembly of two half-boxes 3 and 4 along a joint plane passing through XX'. Each half-box comprises, on its inside surface, a means of guidance such as a groove 5 respectively 6, parallel to the plane of the figure, these two grooves being parallel, and, outside, a hook 7, respectively 8, that forms, when the box is assembled, a securing claw to render the box solid with a switching mechanism, such as a contactor 9. Each half-box has moreover a drilled portion, 10, respectively 11, these two portions being aligned when the half-boxes are assembled.

A coupling piece 12 (also see FIG. 2) which takes the form of a U with two parallel opposed branches 13 and 14 and a common cross-piece 15, is placed in the box so that it slides in the plane of FIG. 1 by means of a guide system which is applied to it when the branches are placed in the grooves 5, respectively 6.

Cross-piece 15 is fitted with an association part 16 having, for example, the form of a T that crosses through a bottom opening 17 of the box to become solid with a mobile component 18 of the contactor 9, causing the contacts of the latter to move or carrying the said contacts, and which is solid with the armature of the contactor (also see FIG. 8).

On one side of this cross-piece, opposite to the association part, are placed two thrust surfaces 19 and 20 (these are seen better in FIG. 2). These two surfaces which are slightly inclined to an angle $\beta$ in relation to a plane perpendicular to that of FIG. 2 (also see FIG. 5) are placed at two different levels, $n_1$ and $n_2$, that are defined in relation to the direction, F or G, of the rectilinear movement of the coupling piece.

It may be seen, referring to FIG. 1, that the ends of a cylindrical rod 21 are placed in the drillings 10 and 11 to constitute a spindle common to two levers 23, respectively 24 and around which they pivot, the pivots being numbered 23*a* and 24*a*.

Figure 3:
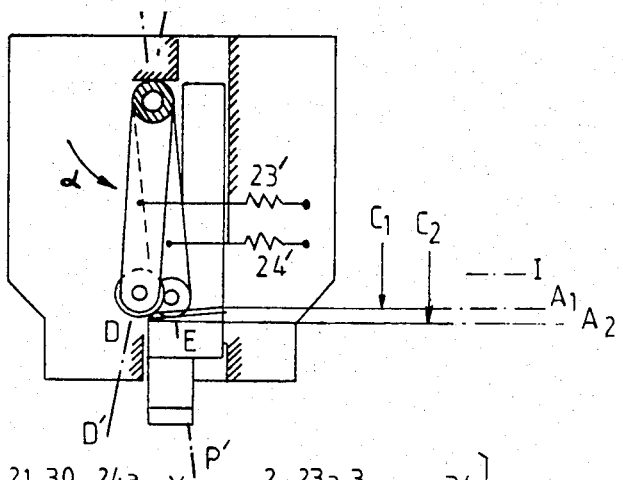
FIG. 3 illustrates a partial cross-sectional side view through plane RR' of FIG. 1 without the electromagnet.

These two levers are each fitted, at their free ends, 25 and 26, with a roller 27, respectively 28. These levers are moreover submitted to elastic forces imparted by springs 23' and 24' respectively that tend to communicate to them movements of rotation in the same direction $\alpha$ towards the coupling piece in order to bring each roller as explained above, into contact with a particular thrust surface (see FIGS. 3 and 1).

When the mobile component 18 of contactor 9 is moved towards the bottom of the figure by its electromagnet, in direction F, the coupling piece associated with it follows an identical movement. When the contactor is off, the coupling piece 12 is in inactive position I and the two levers are each in a released position "D" in the plane DD' (also see FIG. 3). If the travel reaches a first value $C_1$, for which part 12 reaches a first active position $A_1$, one of the rollers, that is, roller 28, which is opposite thrust surface 20, comes to bear on the latter to hold it later in position $A_1$ which it reaches with lever 24 then being in the engaged position. Surface 20 is that which is furthest from spindle 21.

If for the reasons explained above, the travel reaches a second value $C_2$ higher than the first, the second lever 23 also takes up an engaged position in the plane PP' and the second roller 27 bears in its turn on thrust surface 19 opposite, to maintain it in the second active position $A_2$ which it reaches in its turn.

The distances between bearing surfaces will be selected in relation to the extra distance that separates $C_2$ from $C_1$ so that, for any distance greater than or equal to $C_1$, the first roller 28 engages above the first surface 20 and that, for any distance greater than or equal to $C_2$, the second roller 27 engages above the second surface 19 and the first roller is not, in the latter case, used to lock the first surface.

This is the reason why, for example, for any distance between 4.8 and 5.5 mm, only the first roller is engaged while, for any distance greater than 5.5 mm (and, for example, between 5.5 mm and 6 mm), the first roller is first engaged but performs no action of locking which is then effected by the second roller the locking action of which is substituted for that of the first above a distance of 5.5 mm. In another connection, the angle $\beta$ and the position of the pivoting spindle of levers 21 are selected so that each lever, and therefore each roller, is able to pass from one side to the other of plane PP' passing substantially through this axis perpendicular to the corresponding thrust surface.

The direction that must be taken by one of the levers, 23 or 24, in plane PP' to effectively lock coupling piece 12 may be provided either by cooperation of a roller such as 28 (see FIG. 4) with a lateral abutment surface such as 29 carried by part 12, or by association of a surface 30 carried by lever 24 near to pivot 24 with an abutment surface 31 of the box.

An electromagnet 32 designed remotely to control unlocking of the levers consists of a casing 33 on which is placed a coil 34 connected to terminals such as 35 and in which is a drilling 36 that may serve to guide a plunger core 37 that moves along axis YY' perpendicular to the plane of movement of the coupling piece. A U-shaped casing, not illustrated, is provided to enclose the flux of the electromagnet.

Casing 33 and the coil pass through the coupling piece between the two levers providing an economy of space; the casing moreover has one end 38 that bears on the wall 39 of the box so that its position, in relation to the levers, is correctly placed in the direction YY'.

The casing has two side walls, such as 40, which are associated with the half-boxes so that its position is correctly set in directions perpendicular to YY'.

The plunger core 37 carries, outside the coil, a push rod 41 with two pins 42 and 43, parallel to YY' that are placed opposite to levers 23 and 24 and an extension piece 44 that crosses a groove 45 of box 2 and/or of the casing; this extension piece is fitted with a manually actuated button 46 that allows the plunger to be moved independently of the coil.

A weak return spring 47 gives, to the plunger core and the push rod, an "off position" that is set by the thrust of the latter on wall 48 of the box, opposite wall 39; use of such a spring may be dispensed with if the position of the box allows gravity to exercise a similar function.

The thrust surfaces 19 and 20 of the coupling piece have been directed in FIG. 5 at a certain angle $\beta$ to facilitate engagement of the rollers and to ensure that the power required for unlocking is very low; such a precaution is not essential for the instrument to function because surfaces 19' and 20' (see FIG. 6) can also be placed perpendicular to their direction of movement F and G on condition that the straight line $\Delta$ that passes substantially through pivot 21 and through contact point 49 of roller 27, 28 makes an angle $\phi$ slightly greater than 90° with the surface 19', 20'; in the latter case, the unlocking electromagnet 32 must supply power greater than that required in the previous case.

FIG. 7 illustrates how grooves 50 and 51, placed in the side walls 52 and 53 of the casing of coil 33, provide guidance of ribs 54 and 55 of push rod 41 when the plunger core 37 is not guided in bore 36. The two levers 23 and 24 are preferably identical.

In order to supply coil 34 of unlocking electromagnet 32 with a short current pulse, the inside circuit 56 includes, in series (see FIG. 8), a switch 57 the mobile contact 58 of which is placed on the coupling piece 12 (particularly, in a window 60 of branch 14) so that the switch is closed when contact 9 moves piece 12 in direction F, and is opened in the contrary case; a second terminal 35' ends the internal feed circuit 56.

Operation of mechanism 1 starts when contactor 9 is energized and when the coupling piece is driven by piece 18 against the action of a return spring 59 in the direction F, performing a stroke $C_1$ or $C_2$.

As soon as thrust surfaces 20 or 19 are opposite rollers 28 or 27 respectively, after the relevant strokes, locking lever 24 or 23 respectively, maintains the coupling piece in an active position A such that pressure is maintained on the contactor contacts; if the electromagnet of the contactor is then de-energized its armature remains practically in the same position.

In order to open the contactor contacts, a current pulse is applied to terminal 35 and 58 of mechanism 1 and energizes the unlocking electromagnet 32 because of the closed state of switch 57.

Figure 4:
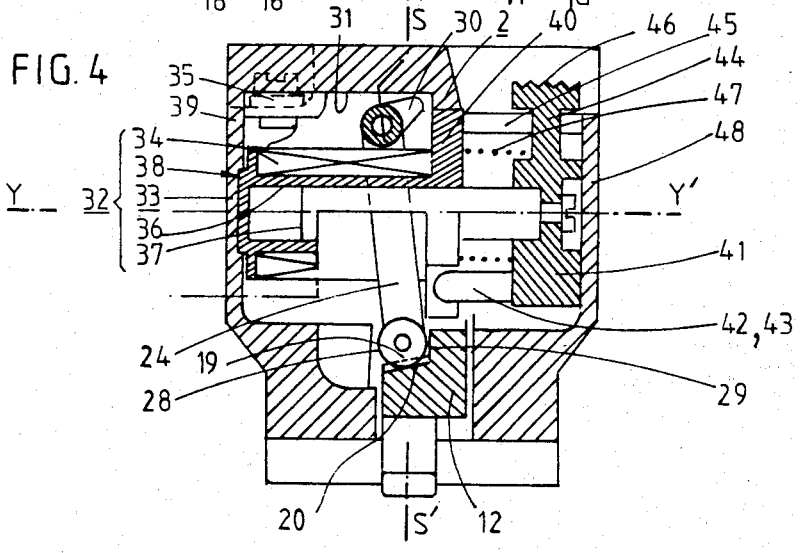
FIG. 4 illustrates a cross-sectional side view through plane RR' of FIG. 1.

Movement of the plunger causes push rod 41 to strike levers 23 and 24, and rotates them in the clockwise direction of FIG. 4 and, because thrust surfaces 19 and 20 escape from rollers 27 and 28, return spring 59 of the armature or of piece 18 of contactor 9 moves the coupling piece 12 in the direction G to give it an inactive position I in which switch 57 is open.

Figure 9:
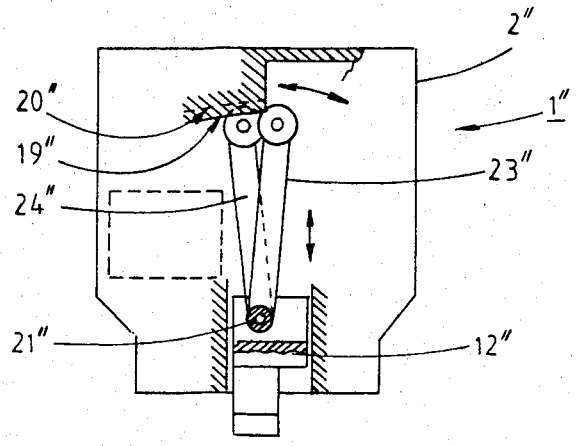
FIGS. 9 and 10 illustrate two variants of construction of the device in accordance with the invention.

In the modified embodiment of FIG. 9, wherein the locking device is denoted by reference numeral 1'', levers 23'' and 24'' are pivoted at 21'' on a coupling piece 12'' while thrust surfaces 19'' and 20'' bear on the upper region of the box 2''.

In the embodiment of FIG. 9, as the thrust surfaces and the free ends of the levers are placed in the upper region of box 2'', the space left for the connection terminals is reduced, and it is more difficult to mount the lever return springs.

Figure 10:
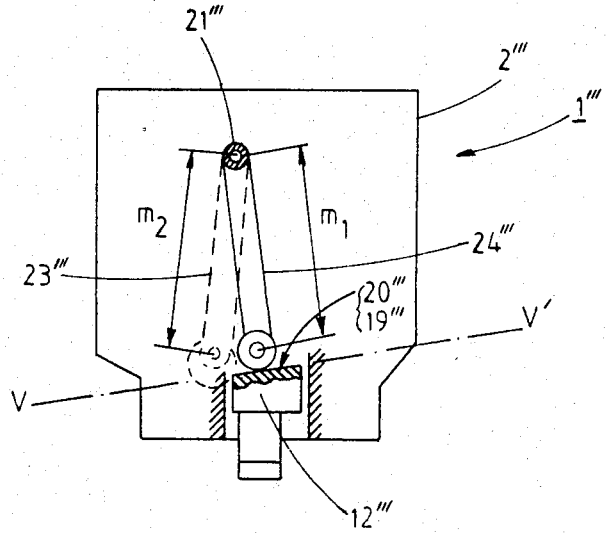

In the embodiment of FIG. 10, the two levers 23''' and 24''' which pivot on the same axis 21''' in a box 2''' are of different lengths $m_1$ and $m_2$ while the thrust surfaces 19''' and 20''' which are placed on the same coupling piece 12''' are in the same plane VV'. In operation, the two levers will bear one after the other against the thrust surfaces to provide locking when the coupling piece has effected strokes of different lengths.

It will also be possible to use, either levers of different lengths and distinct thrust surfaces at the same time, or thrust surfaces placed in the same plane and levers of the same lengths, the pivoting spindles of which being offset to present their rollers at two distinct levels.

It is nevertheless preferable that the levers be of the same lengths because one type of lever only can then be used to implement the device.

It will finally also be possible to use a first lever held by the coupling piece and able to cooperate with a thrust surface placed on the box, and a second lever that will pivot in the box and be able to cooperate with a thrust surface placed on the coupling piece.

We claim:

1. In combination with a contactor having contacts and a contact controlling movable member translatable along a predetermined direction from a rest position in which the said contacts are open into an actuated position in which the said contacts are closed, the said actuated position being located at a distance from the rest position which is either smaller than a first predetermined value, comprised between said first and second predetermined value or higher than the second predetermined value, a locking device comprising:

(a) a coupling member rigidly connected to said contact controlling movable member and first and second thrust plane surfaces substantially at right angles to the said predetermined direction;

(b) first and second elongate substantially parallel locking levers mounted for oscillating about a stationary axis which is substantially parallel to said thrust plane surfaces, each lever having a locking surface at the end thereof remote from said axis, the respective distances from the said axis to the respective thrust surfaces and the respective distances from the said axis to the respective locking surfaces being so predetermined that the locking surface of the first lever will engage the first thrust surface when the said actuated position is located at a distance from the said rest position smaller than the said first predetermined value, whereas the locking surface of the second lever will engage the second thrust surface when the said actuated position is located at a distance from the said rest position comprised between said first and second predetermined values;

(c) first and second spring means respectively attached to the first and second levers for pivoting the said levers from a rest position in a direction which brings their respective locking surfaces into engagement with the respective thrust plane surface; and (d) unlocking means comprising a power supply circuit and an electromagnet having a coil connected in said power supplying circuit and a movable member, said unlocking means further comprising mechanical means for transmitting the movement of said movable member to said locking levers to reset the said locking levers to their rest position.

2. A locking device as claimed in claim 1, wherein each of the said locking levers has a roller which forms the said locking surface.

3. A locking device as claimed in claim 1, wherein the said coupling member, thrust surfaces, locking levers, spring means and unlocking means are enclosed in a casing and the said axis of the two locking levers comprises a rod the ends of which are pivotally mounted in drillings provided in the said casing and the said thrust surfaces are located on the said coupling member.

4. A locking device as claimed in claim 3 wherein the said coupling member, thrust surfaces, locking levers, spring means and unlocking means are enclosed in a casing and the said axis of the two locking levers is mounted on the said coupling member whereas the said thrust surfaces are carried by the casing.

5. A locking device as claimed in claim 1, wherein the respective distances from the said axis to the two locking surfaces are identical, whereas the two thrust surfaces are located at two different distances from the said axis.

6. A locking device as claimed in claim 1, wherein the respective distances from the said axis to the two locking levers are different, whereas the two thrust surfaces are located in the same plane.

7. A locking device as claimed in claim 1, wherein the said coil is located between the two locking levers.

8. A locking device as claimed in claim 1, wherein the said coupling member, thrust surfaces, locking levers, spring means and unlocking means are enclosed in a casing having walls substantially parallel to said predetermined direction; the coupling member is in the shape of a U having two parallel branches and a cross-piece, the said thrust surface being located on the said cross-piece and the said branches being guided along the said walls.

9. A locking device as claimed in claim 8, wherein one branch of the coupling member carries a mobile contact forming part of a switch connected in series with the said coil in the said power supply circuit.

* * * * *